United States Patent [19]

Kelly

[11] Patent Number: 4,534,729

[45] Date of Patent: Aug. 13, 1985

[54] MANTLE SUPPORT DEVICE

[75] Inventor: Ward L. Kelly, Santa Rosa, Calif.

[73] Assignee: 49er Products, Sun Valley, Calif.

[21] Appl. No.: 536,748

[22] Filed: Sep. 28, 1983

[51] Int. Cl.[3] ..... F21H 7/00

[52] U.S. Cl. ..... 431/110; 431/112; 431/344

[58] Field of Search ..... 431/344, 105, 112, 100, 431/154, 324, 110; 126/252, 231, 260, 259 R, 256; 248/560, 624; 222/406, 407; 362/445

[56] References Cited

U.S. PATENT DOCUMENTS

| | | | |
|---|---|---|---|
| 530,775 | 12/1894 | Horwitz | 431/112 |
| 731,961 | 11/1902 | Siegel | 431/112 |
| 924,689 | 6/1909 | Rosengren | 431/112 |
| 1,021,163 | 3/1912 | Rider | 431/112 X |
| 3,130,569 | 4/1964 | Lee | 431/112 X |
| 4,338,075 | 7/1982 | Bemm | 431/344 |

*Primary Examiner*—Randall L. Green

*Attorney, Agent, or Firm*—Limbach, Limbach & Sutton

[57] ABSTRACT

In a device for the burning of gas by means of a mantle the improvement comprises a support for the mantle. The support includes attachment means for connecting it to a gas outlet tube emanating from the device. Lower body means is connected to the attachment means which is characterized as being substantially incapable of communicating significant amounts of gas from the interior to the exterior side wall of the lower body means. Connected thereto is an upper body means which is characterized as having a substantially porous side wall for the communication of gas to its exterior. A support plate having a substantially circular configuration is connected to the upper body means and, finally, mantle piercing means is caused to emanate from the support plate.

15 Claims, 3 Drawing Figures

MANTLE SUPPORT DEVICE

DESCRIPTION

1. Technical Field of Invention

The present invention deals with a support device which is capable of suspending a common mantle in a lantern or campstove. The support is capable of converting a common campstove into a lantern without needing any additional apparatus.

2. Background of the Invention

Mantles used for lighting and heating have been popular for quite some time. In the most popular lamps employing such devices, the mantle is suspended downward and is affixed to the open end of a tube by means of a simple drawstring. The fuel is gas which is mixed with air prior to being fed to the mantle in a predetermined, controlled rate of flow.

Commonly used mantles are in the form of a cylindrical pocket, closed at one end and having a drawstring at the open end. The mantle, itself, is made of a woven cloth which has been coated or otherwise permeated with a refractory material. Prior to the first use of a new mantle, it is placed on the gas outlet tube of a lantern and then ignited. As the woven fabric burns away, the mantle shrinks and is transformed into an extremely fragile and brittle structure consisting mostly of the refractory material. As the mantle is suspended in a downward orientation, its shrinkage and brittleness upon initial ignition does not present a serious problem. The mantle simply and naturally shrinks but does not collapse due to the force of gravity which maintains the closed end of the mantle spaced from the gas outlet tube.

Difficulties arise, however, when a standard mantle is used on a device having an "upright post". Not only are some lamps of this design, but most campstoves are provided with upright posts or burners and any use of a mantle in converting the campstove to a lantern will naturally result in the lantern having an upright-post design. As is readily apparent, if the mantle is tied to a post extending all the way into its interior, it cannot shorten as it shrinks and will undoubtedly tear. On the other hand, if the mantle is tied so that the post extends only partially into the mantle, it will collapse inward or to the side as it shrinks.

One manner of dealing with this problem has been the use of mantles of special design. For example, there is currently available, a mantle constructed in the shape of two cones placed base to base. The mantle possesses a hole in each extreme end whereby one hole is just large enough to slide over the gas outlet tube while the other is smaller and fits over a small projection at the top of the post. Thus when burned, this type of mantle shrinks circumferentially. Although this presents a reasonable solution to the above described problem, the mantle is much more expensive to manufacture than the single drawstring type commonly in use.

As an alternative, this problem has been "solved" to some degree by modifying a standard single drawstring mantle by opening or cutting off a portion of its closed end and applying it to a specially configured post. The gas outlet post has a short section of relatively large diameter tubing affixed to its top and the mantle is tied around this section which passes through the open area in the mantle body. Unfortunately, this approach results in a lantern which produces intense light and resulting excessive heat and fuel consumption.

Yet a third approach to the problem is taught in U.S. Pat. No. 4,338,075. As noted therein, the patentee describes a support for a standard single drawstring mantle which, in theory, seems to solve the problem but, in practice, is anything but a solution. More specifically, the patentee teaches that the mantle is to be loosely tied around a porous support piece having a deflection plate at its end remote from the gas inlet pipe. The patentee relies upon the assumption that the mantle, when first ignited, will burn quickly and evenly around its lower circumference, that the mantle will burn and shrink evenly and that burning will progress over the edge of the deflection plate uniformly. Unfortunately, in practice, this does not happen and the mantle resultantly often tears. Lastly, even if the mantle were to shrink as the patentee intends, the deflection plate, being of a size which the patentee believes is necessary in supporting the mantle structure results in a substantial loss of illumination.

It is thus an object of the present invention to provide a mantle support which eliminates the drawbacks of the prior art.

It is yet another object of the present invention to provide a mantle support which is primarily useful when an upright gas outlet tube is employed which substantially prevents the mantle from experiencing tearing or collapse after ignition.

It is yet another object of the present invention to provide a mantle support which can be readily attached to a campstove in order to convert the campstove to a gas burning mantle lantern.

These and further objects of the present invention will be more readily appreciated when considering the following disclosure and appended drawings wherein.

SUMMARY OF THE INVENTION

The present invention deals with a support for a mantle useful in gas burning lanterns and campstoves. The support comprises attachment means for connecting the support to a gas outlet tube emanating from the device. The support is particularly advantageous when the gas outlet tube projects in an upright configuration.

Connected to the attachment means is a lower body means characterized as being substantially incapable of communicating significant amounts of gas from the interior to the exterior of the lower body means through its side wall. Upper body means is connected to the lower body means which is, in turn, characterized as having a substantially porous side wall for the communication of gas to the exterior of said upper body means.

A support plate is connected to the upper body means having a substantially circular configuration. Finally, attached to the support plate is a mantle piercing means which is, in its preferred embodiment, removable from the support device.

DETAILED DESCRIPTION OF THE INVENTION

Figure 1:
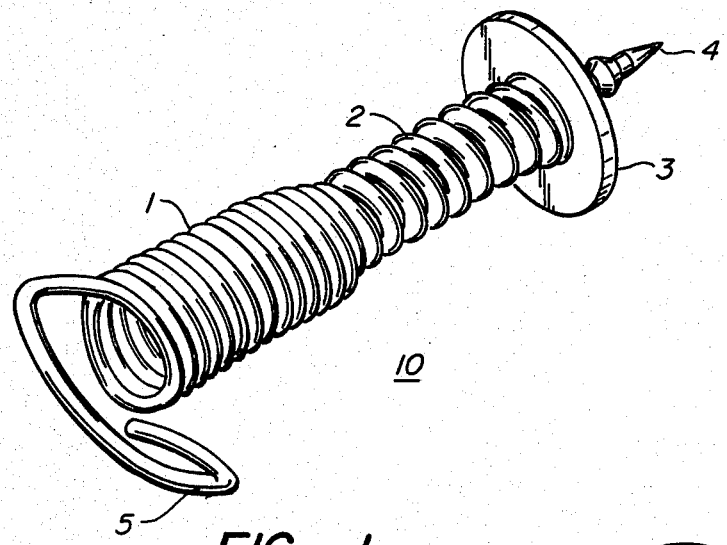
FIG. 1 is a perspective view of the support of the present invention.

The support of the present invention can be more readily visualized by viewing FIG. 1. In its preferred embodiment, support 10 is in large part constructed from a single piece of spirally wound wire. As such, lower body means 1 is shown as wire wound in a relatively tight spiral to substantially prevent a significant amount of gas from escaping from the interior of the lower body means through the wire spiral. Connected to the upper extremity of lower body means 1 is upper body means 2 which is depicted as a continuation of the wire spiral in a relatively loose or open configuration. The loose configuration allows gas to substantially freely escape from the interior of upper body means 2 through the spiral body.

Connected to the lower extremity of lower body means 1 is attachment means 5. In FIG. 1, the attachment means is shown as a continuation of the wire configured in the form of a spring. It is this spring which provides for the attachment of support 10 to gas outlet tube 8 (FIG. 2).

Attachment means 5 actually performs a dual function. Firstly, it obviously provides a convenient connection means between the mantle support and the gas outlet tube. Secondarily, it results in outlet tube 7 being pressed against one side of lower body means 1 which results in a spacing or air gap existing at the support-outlet tube interface. This gap provides an air inlet source so that a mantle requiring an air-gas mixture for proper burning can be used with a campstove which feeds only pure fuel to the gas outlet tube.

Another improved feature of the device of the present invention is the provision of a support body which has an open or gas permeable configuration only in that portion which is intended to reside within the body of the mantle. By contrast, the device disclosed and claimed in U.S. Pat. No. 4,338,075 teaches a support which is porous or gas permeable throughout the support side wall. It was found that such a configuration encourages the flaring up or unwanted combustion of the air/fuel mixture below the mantle body.

Figure 3:
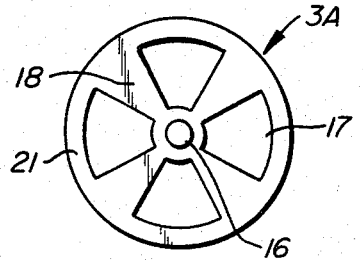
FIG. 3 is a plan view of an alternative support plate useful in carrying out the present invention.
Figure 2:
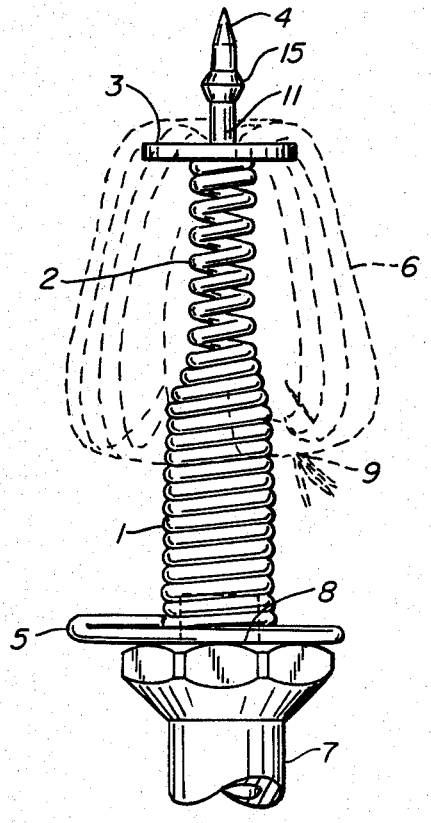
FIG. 2 is a plan view of the support of the present invention in conjunction with a standard gas burning mantle and the extremity of a gas outlet tube.

Placement of the mantle upon the support of the present invention is illustrated in FIG. 2. As noted in the preceding paragraph, mantle 6 is placed over the support and tied on the support body at a location proximate the interface of lower body means 1 and upper body means 2. The top of the mantle is punctured at 11 by mantle piercing means 4 which holds the mantle down by means of expanded portion 15 preventing it from toppling to one side as it burns. Mantle piercing means 4 further prevents the mantle from drawing tightly over the edge of support plate 3, which encourages the mantle to shrink uniformly without tearing. As a further preferred embodiment, mantle piercing means 4 is removable from the support by providing a screw connection (not shown) for removal of support plate 3. When the present invention is used with a suitable mantle which does not require the support plate, it can be removed as indicated. Further variations of support plate 3 can be provided, such as plate 3*a* depicted in FIG. 3. As shown, support plate 3*a* is provided with center hole 16 for passage of spike 4 as well as open areas 17 and resultant spokes 18. Such a configuration enables the avoidance of flame-out at high gas flow. Although the configuration shown in FIG. 3 is merely illustrative of various geometrical configurations useful in practicing this invention, it is typical of a preferred support plate—in this case having the physical dimensions of being 0.875 inches in diameter with the spokes 18 being approximately 0.125 inches wide and the rim 21 also being approximately 0.125 inches wide.

It is readily apparent that the spiral body structure of the present invention which, in its preferred embodiment, comprises a single spirally wound wire offers several unique manufacturing advantages. At the outset, the device can be manufactured at a very low cost by employing a standard automatic spring winding machine. Such a machine can wind coils tightly (lower body section 1) as well as relatively open coils (element 2). The upper body means 2 possessing an open configuration creates an extremely uniform gas diffusion and flow pattern to the interior surface of the mantle.

I claim:

1. In a device for the burning of gas by means of a mantle, the improvement being a support for said mantle comprising:

A. attachment means for connecting the support to a gas outlet tube emanating from said device;

B. lower body means connected to the attachment means characterized as being substantially incapable of communicating significant amounts of gas from the interior to the exterior of the lower body means;

C. upper body means connected to the lower body means characterized as having a substantially porous side wall for the communication of gas to the exterior of the upper body means, wherein said upper and lower body means comprises a wire wound in the shape of a spring;

D. a support plate having a substantially circular configuration being connected to said upper body means; and E. mantle piercing means emanating from said support plate.

2. The support of claim 1 wherein the wire comprising the lower body means is wound in a relatively tight spiral to substantially prevent a significant amount of gas from escaping from the interior of said lower body means through the wire spiral.

3. The support of claim 1 wherein the wire comprising the upper body means is wound in a relatively loose spiral to allow gas to substantially freely escape from the interior of said upper body means through the wire spiral.

4. The support of claim 1 wherein said attachment means comprises a spring for connecting the lower body means to said gas outlet tube.

5. The support of claim 4 wherein said spring forces said gas outlet tube against the interior side wall of the lower body means.

6. The support of claim 5 wherein said spring provides a spacing between the gas outlet tube and the interior side wall of the lower body means to provide for venting of air into the support for mixing with the gas emanating from the gas outlet tube.

7. The support of claim 1 wherein the attachment means, lower body means and upper body means are comprised of a single continuous wire.

8. The support of claim 1 wherein said mantle piercing means is removable from said support.

9. The support of claim 1 wherein said support plate is characterized as being connected to said upper body means at approximately the geometric center of the support plate.

10. The support of claim 9 wherein said piercing means passes through the support plate at approximately the geometric center of the support plate.

11. The support of claim 1 wherein said device for the burning of gas comprises a lantern.

12. The support of claim 1 wherein said device for the burning of gas comprises a campstove.

13. The support of claim 1 wherein said support plate is removable from said support.

14. The support of claim 1 wherein said piercing means possesses an expanded portion to aid in maintaining the mantle in position.

15. The support of claim 1 wherein said support plate possesses cut-out portions to reduce flame-out at high gas flows.

* * * * *